United States Patent [19]

Keller

[11] Patent Number: 4,599,802

[45] Date of Patent: Jul. 15, 1986

[54] DRAFTSMAN'S DIMENSIONAL DIVIDER

[76] Inventor: Walter L. Keller, 3901 Gordon Dr. S., Naples, Fla. 33940

[21] Appl. No.: 752,811

[22] Filed: Jul. 8, 1985

[51] Int. Cl.[4] ..... B43L 9/08

[52] U.S. Cl. ..... 33/192

[58] Field of Search ..... 33/150, 192

[56] References Cited

U.S. PATENT DOCUMENTS 736,168 8/1903 Stinson ..... 33/192

1,996,217 4/1935 Steiner ..... 33/192

FOREIGN PATENT DOCUMENTS 282177 12/1927 United Kingdom ..... 33/192

*Primary Examiner*—Harry N. Haroian

*Attorney, Agent, or Firm*—Merrill N. Johnson

[57] ABSTRACT

A device for use in dividing a line into a predetermined number of equal parts. The device consists of a number of identical elongated links whose ends and centers are hingedly connected to form a set of extendable lazy tongs with preferably sixteen identical pointed rods attached to the hinged ends on one side of the set of lazy tongs. A case encloses the set of lazy tongs with the pointed ends of the rods projecting out of an elongated slot along the bottom of the case. One end of the set of lazy tongs is attached to one end of the case while the other end of the set of lazy tongs is attached to a slidable shaft which extends through a second elongated slot along the side of the case. The shaft is attached to a finger operated tab slidable along the second elongated slot for moving the lazy tongs and the pointed rods so that the pointed ends of two predetermined rods lie at the ends of a line to be divided into equal parts.

9 Claims, 7 Drawing Figures

DRAFTSMAN'S DIMENSIONAL DIVIDER

BACKGROUND AND SUMMARY OF THE INVENTION

The present invention relates to a device for use by draftsmen and the like who wish to quickly divide a line of given length into a given number of equal parts, which device I call a dimensional divider.

The person preparing a set of plans on a drafting board and especially an architectural draftsman is often faced with the problem of dividing a drawn line into a given number of equal parts. While the problem can be solved in various ways, known solutions take time and are tedious. However, so far as I am aware there is no draftsman's tool available to quickly divide a line into a desired number of equal segments.

Using the principle of the well known extendable "lazy tongs," I have invented a dimensional divider which when placed on a drafting board with the pressure of a thumb or finger will divide a drawn line into a predetermined number of equal parts.

Briefly stated, my dimensional divider includes a plurality of flat elongated links whose two ends and centers are hingedly pinned or otherwise connected together to form an extendable set of what are commonly called lazy tongs. Preferably this set of lazy tongs has 30 links which will provide sixteen hinged ends on each side of set of lazy tongs. Sixteen identical pointed rods or pointers are attached to the sixteen pins hingedly connecting the ends of one side of the lazy tongs. A case encloses said set of tongs with the pointed ends of the rods projecting out of a first elongated slot along the bottom of the case.

One end of the set of tongs is fixedly attached to one end of the case while the other end of the tongs is attached to a shaft which extends through a second elongated slot running along the side of the case. This shaft is attached to a finger-operated tab which is slidable along the second elongated slot so as to move the set of lazy tongs and the pointers projecting out of the bottom of the case back and forth along the length of the case.

Preferably the case is approximately 18 inches long, 2½ inches high and 1⅛ inches wide and made of a high density thermoplastic material such as styrene. The links of the lazy tongs, the pins connecting the links, the pointers and other moving parts are made of either stainless steel or corrosion resistant plastic material.

To use the dimensional divider to divide a line into equal parts, the divider is placed over the line with the pointer nearest the end of the divider resting on one end of the line. If the line is to be divided say into 12 equal parts, the finger-operated tab is slid along the slot in the side of the case of the divider until the 13th pointer (counting from the pointer nearest the end of the divider) is resting on the opposite end of the drawn line. The pointers in between the first and 13th pointers will then indicate the points along the line which divide it into 12 equal segments. These points can be easily marked on the line and the divider then removed from the drafting board.

DESCRIPTION OF THE PREFERRED EMBODIMENT

Figure 1:
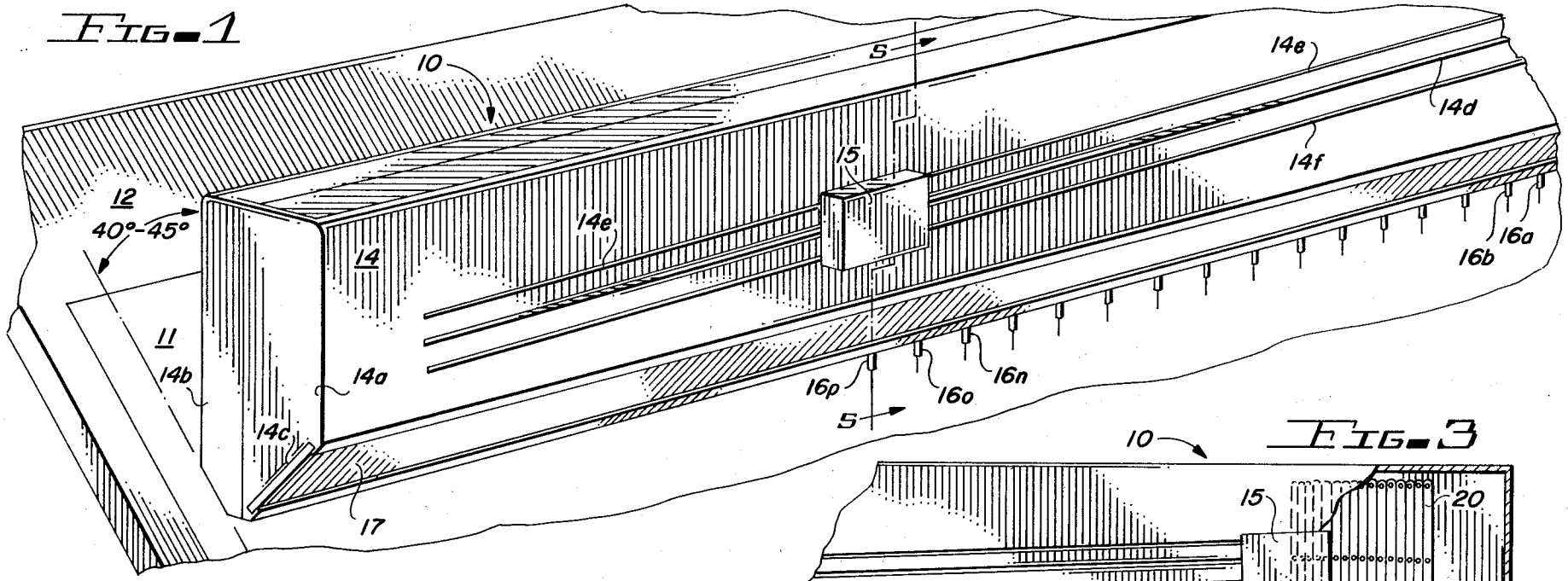
FIG. 1 is a perspective view partially cut away illustrating my dimensional divider being used on a drawing board.
Figure 2:
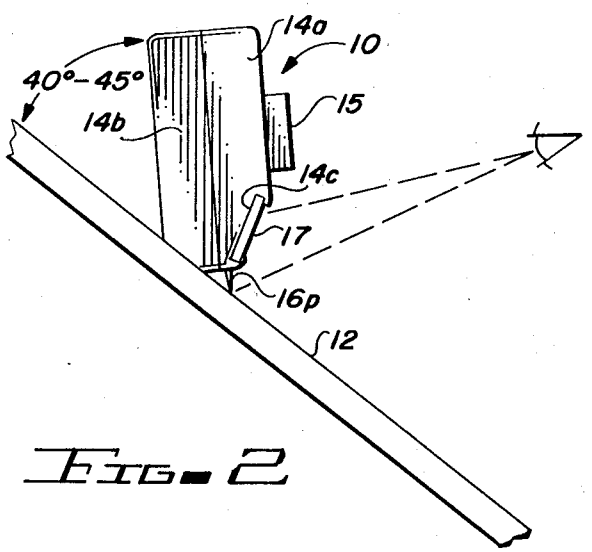
FIG. 2 is an end view of the divider shown in FIG. 1 in use on a drawing board.

FIGS. 1 and 2 illustrate a preferred embodiment of the dimensional divider 10 in use on a sheet of paper 11 affixed to a drawing board 12.

The major portion of the moving parts of divider 10 are enclosed within a preferably plastic elongated case 14 having two parts, namely, a front cover 14*a* and a back cover 14*b*. Case 10 is 18 inches long, 2½ inches in height, and 1⅛ inches wide. A finger-operated tab 15 slidably mounted on front cover 14*a* is provided to move the linkage within case 14 back and forth along the length of the case.

As best shown in FIG. 1 a total of 16 pointed cylindrical rods or pointers 16*a* through 16*p* project through an elongated slot which extends along the bottom of case 14. A grooved slot 14*c* also extends along the lower sloping edge of front cover 14*a* adapted to received any one of a variety of inserts 17 printed with a scale, i.e., inches, metric, 1:100, etc., to aid the particular user of the divider.

The preferred method of using the dimensional divider is shown in FIG. 2. The divider is held in a vertical position with the lower sloped edge of back cover 14*b* resting on the drawing board and the pointers 16 lying along the line to be divided. The draftsman's eye can thus see both the pointers 16 and the scale on insert 17.

Referring now to FIGS. 3–7, the linkage within case 14 consists mainly of a set of lazy tongs and attached pointers 16*a*–*p* and means for moving the tongs and pointers back and forth along the length of case 14.

Figure 3:
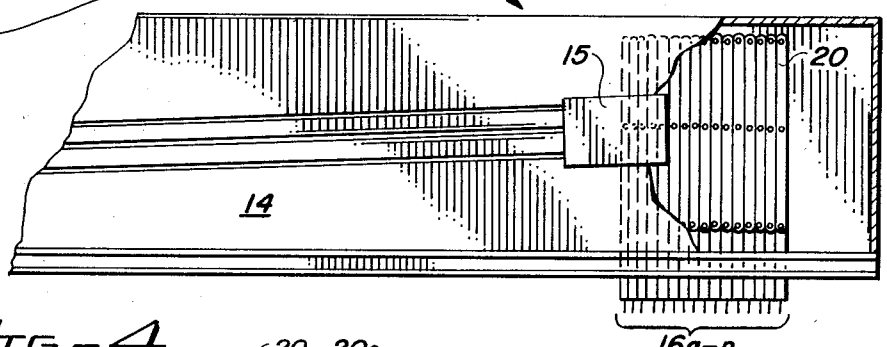
FIG. 3 is a front view of the divider partially cut away showing the lazy tongs in a closed position.
Figure 4:
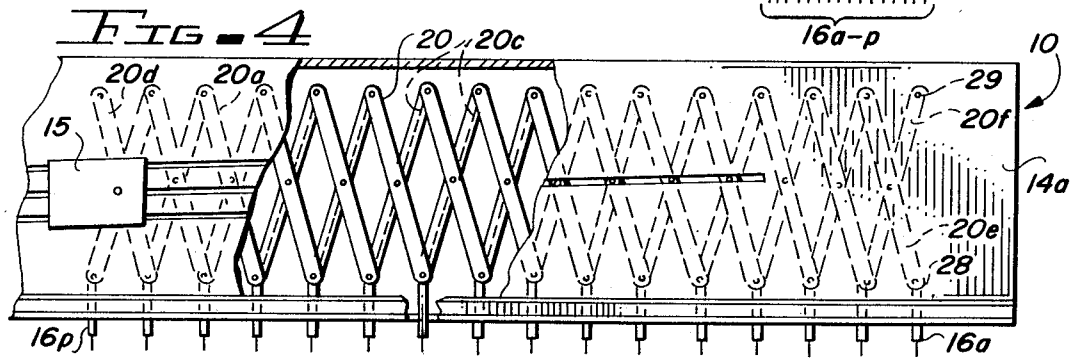
FIG. 4 is another front view of the divider partially cut away showing the lazy tongs in a partially extended position.

FIG. 3 shows the set of tongs in their closed position with pointers 16 close to each other. FIG. 4 shows the set of tongs partially extended with pointers 16 spaced equally apart from each other. The set of lazy tongs is made of a series of identical flat elongated links 20 preferably made of stainless steel or a high impact plastic such as styrene.

Links 20 are joined together at both their two ends and their centers by a number of generally cylindrical shafts which act as hinges. To provide stability and prevent binding as the set of lazy tongs moves back and forth within case 14, at each successive joinder of the ends of the links a single link is connected to two parallel links. This preferred arrangement is best illustrated in FIG. 5 where upper shaft 21 connects a single link 20*a* with two parallel links 20*b* and 20*c* whose centers connect to intermediate shaft 22 and whose lower ends connect to lower shaft 23 which also supports pointer 16*p*.

Figure 7:
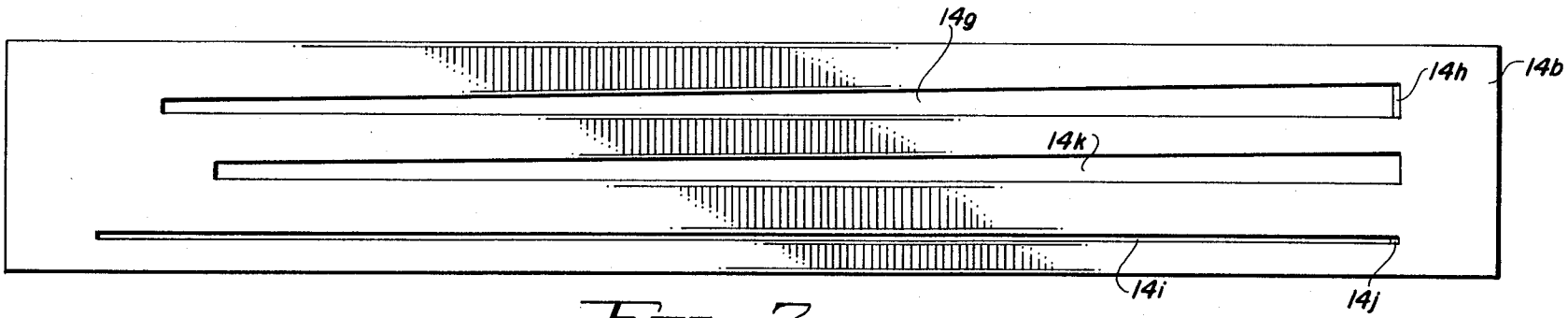
FIG. 7 is a front view of the back side of the case of the dimensional divider.

One end of the set of lazy tongs is permanently affixed to case 14. In the preferred embodiment this is accomplished by link 20*e* having its lower end connected to a shaft 28 which fits into a deep recess 14*j* in back cover 14*b* and a similar recess in front cover 14*a*, and by having link 20*f* and a parallel link having their upper ends connected to a shaft 29 which fits into a deep recess 14*h* in back cover 14*b* and a similar recess in front cover 14*a* as shown in FIGS. 4 and 7.

Figure 5:
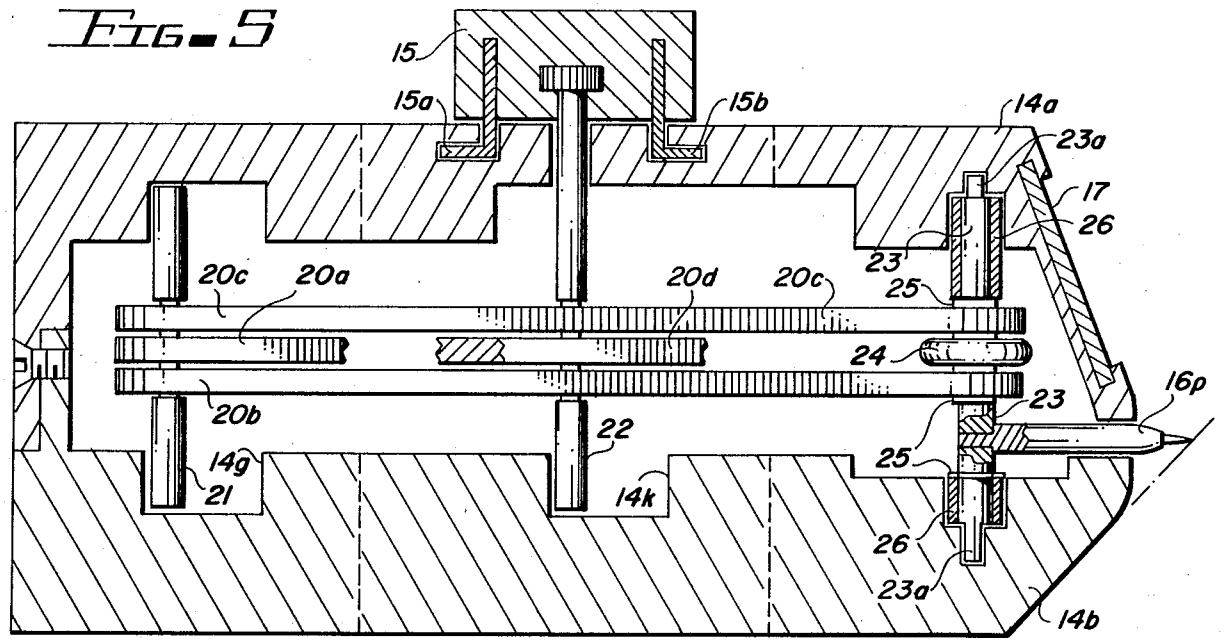
FIG. 5 is an enlarged cross sectional view taken along line 5—5 of FIG. 1 showing details of the construction of a preferred embodiment of my dimensional divider.

The set of lazy tongs and pointers 16*b–p* are moved back and forth within case 14 by finger-operated tab 15 which is connected to shaft 22 as shown in FIG. 5. The movement of tab 15 along slot 14*d* is assisted by L-shaped keepers 15*a* and 15*b* projecting from tab 15 as shown in FIG. 5 and which fit respectively into tab tracks 14*e* and 14*f* running parallel to slot 14*d* on front cover 14*a*.

As the set of lazy tongs moves in response to movement of finger-operated tab 15, the ends of the series of upper shafts 21 will move along an upper groove 14*g* in back cover 14*b* and a similar groove in front cover 14*a*. At the same time the opposite ends of the series of lower shafts 23 will slide along a narrow groove 14*i* running from deep recess 14*j* along the bottom of cover 14*b* and a similar groove in front cover 14*a*.

Figure 6:
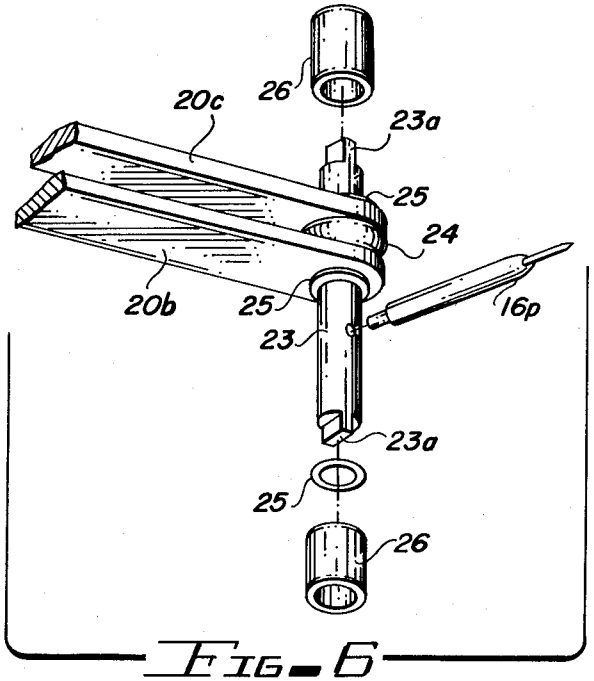
FIG. 6 is a detailed perspective view showing the connection of the pointer to the shaft and lazy tongs.

In order to keep each of pointers 16*a–p* in a truly vertical position and parallel to all the other pointers, lower shaft 23 includes at each of its ends a flat faced lug 23*a* shown in FIGS. 5 and 6. Lugs 23*a* riding in groove 14*i* and a similar groove in front cover 14*a* prevent shaft 23 from rotating and thereby disturbing the parallel relationship of the pointers to each other.

To prevent binding and misalignment of the moving parts, a set of bushings or rollers 26 surround the ends of each shaft 23 nearest lugs 23*a* and a set of spring washers 25 lie on both sides of each link. Since the shaft which supports pointer 16*p* is at the end of the set of lazy tongs, links 20*b* and 20*c* are separated by washer 24 rather than by the end of another single link as is the case of the shafts which support pointers 16*b* through 16*o*.

In their closest position as shown in FIG. 3, pointers 16*a–p* are 1/16th of an inch apart and in their most extended position, the pointers are about one inch apart. By making case 14 longer, additional pointers can be added as desired. Although the preferred embodiment shows the right side of the lazy tongs attached to the case and the set of tongs opening to the left, the tongs could be attached to the right side of the case and the set of tongs open to the left.

While the preferred embodiment has been fully disclosed and described, various modifications and changes in the shape, size and arrangement of the elements of my dimensional divider may be made without departing from the inventive concepts of my invention. Thus the scope and spirit of my invention is limited only by the following claims.

I claim:

1. A dimensional divider for use in dividing a line of given length into a predetermined number of equal parts comprising:

a plurality of identical elongated flat links whose ends and centers are hingedly connected together by a plurality of cylindrical shafts to form a set of lazy tongs, a plurality of pointed rods, the upper end of each pointed rod being fixedly connected to one of said cylindrical shafts on one side only of the set of lazy tongs, a case enclosing said set of lazy tongs with the pointed ends of said rods projecting out of a first elongated slot along the bottom of said case, one end of said lazy tongs being fixedly attached to one end of said case, one of said shafts being attached to the opposite end of said set of lazy tongs, said shaft extending out through a second elongated slot in the front of said case which is inclined relative to the case bottom, a finger-operable tab attached to said shaft slidable along the second elongated slot through which the shaft extends for moving the lazy tongs and the pointed rods so that the pointed ends of two predetermined rods lie at the extremities of a line to be divided into equal parts, and means for maintaining said pointed rods in parallel position to each other and perpendicular to the bottom of the case.

2. A dimensional divider as set forth in claim 1 in which the two links at the end of the set of lazy tongs which is attached to one end of the case are secured to said case by two of said cylindrical shafts connected to the ends of said two links and the opposite ends of said two shafts are inserted into deep recesses in said case.

3. A dimensional divider for use in dividing a line of given length into a predetermined number of equal parts comprising a plurality of identical flat links whose ends and centers are higedly connected together to form a set of lazy tongs, a plurality of pointed rods, the upper end of each pointed rod being connected to the hinged ends on one side only of the set of lazy tongs, a case enclosing said set of lazy tongs with the pointed ends of said rods projecting out of a first elongated slot along the bottom of said case, one end of said set of lazy tongs being fixedly attached to one end of said case, a shaft attached to the opposite end of said set of lazy tongs, said shaft extending out through a second elongated slot in the front of said case which is inclined with respect to the case bottom, a tab attached to said shaft slidable in tab tracks parallel to and along said second elongated inclined slot through which the shaft extends for moving the set of lazy tongs and the pointed rods so that the pointed ends of two predetermined rods lie at the extremities of a line to be divided into equal parts, and means for maintaining said pointed rods in parallel position to each other and perpendicular to the bottom of the case.

4. A dimensional divider for use in dividing a line of given length into a predetermined number of equal parts comprising thirty identical elongated flat links whose ends and centers are hingedly connected together by forty-seven cylindrical shafts to form a set of lazy tongs, said flat links alternating between two parallel links and a single link to provide stability and prevent binding, sixteen pointed rods, the upper end of each pointed rod being fixedly connected to one of said cylindrical shafts on one side only of the set of lazy tongs, an elongated two-part case having a front cover and a back cover enclosing said set of lazy tongs with the pointed end of each one of said rods projecting out of a first elongated slot running along the bottom of said case, one end of said set of lazy tongs being fixedly attached by means of two of said cylindrical shafts to one end of said case, another of said cylindrical shafts being attached to the opposite end of said set of lazy tongs, said other cylindrical shaft extending out through a second elongated slot in the front cover of said case with this second slot being inclined with respect to the case bottom, a finger-operatable tab attached to said other shaft slidable along the second elongated inclined slot through which that shaft extends for moving the set of lazy tongs and the pointed rods so that the pointed ends of two predetermined rods lie at the extremities of a line to be divided into equal parts, and each of the lower cylindrical shafts having a flat faced lug at its end for riding in respective grooves in the front and back covers of the case for keeping each of the pointed rods in a vertical position and parallel to all the other pointers.

5. A dimensional divider as set forth in claim 4 in which the respective lower cylindrical shafts each have a roller surrounding it.

6. A dimensional divider as set forth in claim 5 in which the movable end of the set of lazy tongs comprises two links, and a washer separates the pointed rod end rather than the end of a single link.

7. A dimensional divider as set forth in claim 1 in which said means for maintaining said pointed rods in parallel position includes each of the lower cylindrical shafts having a flat faced lug at its end for riding in respective grooves in the case of keeping each of the pointed rods in a vertical position and parallel to all of the other pointers.

8. A dimensional divider as set forth in claim 7 in which the respective lower cylindrical shafts each have a roller surrounding it.

9. A dimensional divider as set forth in claim 8 in which the movable end of the set of lazy tongs comprises two links, and a washer separates the pointed rod end rather than the end of a single link.

* * * * *